US009962723B2

(12) United States Patent
Baughman

(10) Patent No.: US 9,962,723 B2
(45) Date of Patent: May 8, 2018

(54) FOAM DISPENSER WITH REVERSIBLE VALVE

(71) Applicant: Rieke Corporation, Auburn, IN (US)

(72) Inventor: Gary M. Baughman, Fremont, IN (US)

(73) Assignee: RIEKE CORPORATION, Auburn, IN (US)

( * ) Notice: Subject to any disclaimer, the term of this patent is extended or adjusted under 35 U.S.C. 154(b) by 347 days.

(21) Appl. No.: 14/723,591

(22) Filed: May 28, 2015

(65) Prior Publication Data

US 2015/0258559 A1 Sep. 17, 2015

Related U.S. Application Data

(63) Continuation of application No. PCT/US2013/071245, filed on Nov. 21, 2013.
(Continued)

(51) Int. Cl.
*B05B 11/00* (2006.01)
*B05B 7/00* (2006.01)

(52) U.S. Cl.
CPC ..... *B05B 11/3087* (2013.01); *B05B 7/0037* (2013.01); *B05B 11/0064* (2013.01);
(Continued)

(58) Field of Classification Search
CPC ..... B05B 7/0037; B05B 11/0064; B05B 11/3001; B05B 11/3087; B05B 11/0018; B05B 11/3025; B05B 11/3059
USPC ..... 222/190, 145.1, 145.5–145.6, 222/321.7–321.9, 189.09–189.11; 417/545–546
See application file for complete search history.

(56) References Cited

U.S. PATENT DOCUMENTS 3,527,242 A 9/1970 Ansite
5,271,530 A 12/1993 Uehira et al.
(Continued)

FOREIGN PATENT DOCUMENTS

CN 102712397 10/2012
CN 102689734 A 3/2016
(Continued)

OTHER PUBLICATIONS

International Search Report and Written Opinion issued in PCT/US2013/070977, dated Mar. 4, 2014.
(Continued)

*Primary Examiner* — Nicholas J Weiss
*Assistant Examiner* — Andrew P Bainbridge
(74) *Attorney, Agent, or Firm* — McDonald Hopkins LLC

(57) ABSTRACT

A foam-dispensing pump includes an actuator, a collar, a housing, an air piston, a liquid piston, a mesh element and an air valve structure. The collar is constructed and arranged for attachment to a liquid storage container and a portion of the actuator is received by the collar. The air piston is constructed and arranged to be moveable within the housing. The liquid piston is constructed and arranged to be moveable within the housing. The mesh element is constructed and arranged to receive air and liquid for the production of foam. The air valve structure includes an annular sleeve component which is assembled onto the liquid piston and a cooperating annular valve element which is received by the air piston.

18 Claims, 12 Drawing Sheets

Related U.S. Application Data

(60) Provisional application No. 61/740,023, filed on Dec. 20, 2012.

(52) U.S. Cl.
CPC ..... *B05B 11/3001* (2013.01); *B05B 11/0018* (2013.01); *B05B 11/3025* (2013.01); *B05B 11/3059* (2013.01)

(56) References Cited

U.S. PATENT DOCUMENTS

| | | | | |
|---|---|---|---|---|
| 5,443,569 | A * | 8/1995 | Uehira | B05B 7/0031 222/190 |
| 6,290,145 | B1 | 9/2001 | Mizushima et al. | |
| 6,398,079 | B1 | 6/2002 | Garcia et al. | |
| 6,536,685 | B2 | 3/2003 | Bennett | |
| 6,612,468 | B2 | 9/2003 | Pritchett et al. | |
| 6,644,516 | B1 | 11/2003 | Foster et al. | |
| 6,840,408 | B1 | 1/2005 | Foster et al. | |
| 6,868,990 | B2 | 3/2005 | Cater et al. | |
| 7,004,356 | B1 * | 2/2006 | Sayers | B05B 7/0037 222/137 |
| 7,048,153 | B2 | 5/2006 | Gentile | |
| 7,198,177 | B2 | 4/2007 | Ganzeboom | |
| 7,802,701 | B2 | 9/2010 | Jahan et al. | |
| 8,056,767 | B2 | 11/2011 | Mizushima et al. | |
| 8,113,389 | B2 | 2/2012 | Lewis et al. | |
| 2005/0115988 | A1 * | 6/2005 | Law | B05B 7/0037 222/145.5 |
| 2005/0205600 | A1 * | 9/2005 | Ophardt | B05B 7/0037 222/1 |
| 2005/0224519 | A1 * | 10/2005 | Law | B05B 7/0025 222/190 |
| 2009/0020552 | A1 | 1/2009 | van der Heijden | |
| 2009/0166382 | A1 * | 7/2009 | Snodgrass | A47K 5/14 222/190 |
| 2010/0111735 | A1 | 5/2010 | Tu | |
| 2011/0031276 | A1 * | 2/2011 | Mizushima | B05B 7/0031 222/190 |
| 2012/0241477 | A1 * | 9/2012 | Uehira | B05B 11/0064 222/190 |
| 2013/0221553 | A1 | 8/2013 | Chen | |

FOREIGN PATENT DOCUMENTS

| | | |
|---|---|---|
| EP | 1911525 A1 | 4/2008 |
| JP | 2011-156445 | 8/2001 |
| JP | 2008-136904 | 6/2008 |
| JP | 2012-012079 | 1/2012 |

OTHER PUBLICATIONS

International Search Report and Written Opinion issued in PCT/US2013/071245, dated Mar. 4, 2014.

* cited by examiner

FOAM DISPENSER WITH REVERSIBLE VALVE

CROSS REFERENCE TO RELATED APPLICATION

This application is a continuation of PCT/US2013/071245 filed Nov. 21, 2013 and also claims the benefit of U.S. Provisional Patent Application Ser. No. 61/740,023 filed Dec. 20, 2012, which is hereby incorporated by reference.

BACKGROUND

Foam-dispensing pumps are constructed and arranged for enabling the mixture of air and a selected liquid, in a desired ratio, for the production of foam. This mixture of air and a selected liquid is pushed through a screen or mesh layer of some suitable material and construction in order for aeration of this mixture to occur. The charge of air is divided into smaller bubbles which are coated with a thin film of the selected liquid. The opening size of the screen (or mesh) and the number of passes through other (optional) downstream screens, typically with smaller openings, influences the "quality" of the foam which is ultimately dispensed to the user. The mixture ratio of the charge of air and the charge of liquid also influences the "quality" of the foam relative to whether the foam is considered too wet and thus runny or too dry and unacceptable.

While the selection of a proper mixture ratio of air and liquid is important, it is also important to have a pump mechanism which is cost-effective to manufacture and is reliable. The concept of "reliable" is embodied, at least in part, in the accuracy of the metering of air and the delivery of liquid for the mixture. "Reliable" is also embodied in the valve structures which perform their metering and delivery responsibilities as intended, and without any noticeable leakage or malfunction.

The air valve structure which is included as part of this disclosed foam-dispensing pump provides a reliable valve structure for use in this type of pump.

SUMMARY

An air valve structure is disclosed which is constructed and arranged for use as part of a foam-dispensing pump. The pump includes an air cylinder for use in delivering a charge of air to a mixing chamber which is upstream from a mesh insert. The air cylinder includes a housing and a reciprocating air piston and the combination defines an interior air chamber. The pump also includes a liquid cylinder for use in delivering a charge of liquid to the mixing chamber. The liquid cylinder includes a portion of the housing and a reciprocating liquid piston.

In one embodiment, as disclosed herein, the pump is assembled to a container which includes a volume of the selected liquid. The representative container has an externally-threaded neck and the pump includes an internally-threaded collar which securely attaches the pump to the container. Other container constructions and other means of connection or attachment are contemplated. In this assembled and attached condition one portion of the pump extends in an axially downward direction into the interior of the container. Another portion of the pump extends in an axially upward direction and protrudes beyond the upper surface of the collar. This "another portion" includes an actuator which defines a dispensing passage and outlet opening for the foam which is produced as the air and liquid mixture passes through and exits from the mesh insert.

The actuator is constructed and arranged to reciprocate axially through an upper opening in the collar. The downward travel of the actuator is the result of manual depression (i.e. a manual downward force on the upper surface of the actuator). The upward travel of the actuator is the result of a spring and a spring-biasing arrangement within the pump. As the actuator is manually pushed in an axially downward direction, an air piston and a liquid piston are each driven axially as the initiating steps in the delivery of air and liquid, respectively. With each stroke of the actuator a charge of air and a charge of liquid are delivered into a mixing area or chamber which is upstream from the mesh insert used for aeration. The flow of air is dependent on the opening of the disclosed air valve so that a portion of the air which is within the air chamber is able to escape as the air chamber volume is reduced by the downward travel of the air piston, as driven by the actuator. When the pressure level within the air chamber is below the resiliency force of the air valve in order to remain open, the mixing air side of the air valve closes.

As the spring arrangement acts on the air piston and thereby pushes upwardly on the actuator, the pump components return to what is best described as their "starting position", ready for another manual actuation (i.e. stroke) and for the delivery of another charge or dose of foam. This upward travel of the air piston creates a vacuum within the air chamber and this negative pressure needs to be relieved by the introduction of make-up air. The disclosed air valve is constructed and arranged to allow the introduction of make-up air into the air chamber. Once the negative pressure within the air chamber returns to a pressure which is near atmospheric pressure, the make-up air side of the air valve closes.

In order to provide these described air valve functions, the disclosed foam-dispensing pump includes an air valve structure which includes an annular sleeve component and an annular valve element. The annular sleeve component is assembled around and rests on a portion of the liquid piston. The valve element is received within the air piston. The sleeve component is used in cooperation with the valve element to control the delivery and amount of air for mixing with the liquid. The valve element is used independently of the sleeve, though in cooperation with the housing, to control the entry of make-up air into the air chamber.

The disclosed air valve structure provides an improved construction which is easy to fabricate and easy to install and which is reliable and accurate in terms of air-flow management. The concept of air-flow management includes both timing and volume.

DESCRIPTION OF SELECTED EMBODIMENTS

Figure 1:
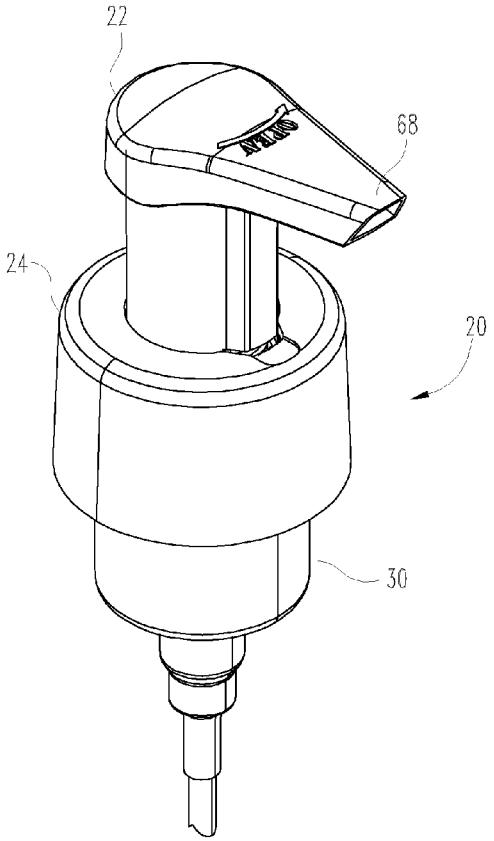
FIG. 1 is a perspective view of a foam-dispensing pump according to the present disclosure.

For the purpose of promoting an understanding of the principles of the invention, reference will now be made to the embodiments illustrated in the drawings and specific language will be used to describe the same. It will nevertheless be understood that no limitation of the scope of the invention is thereby intended. Any alterations and further modifications in the described embodiments, and any further applications of the principles of the invention as described herein are contemplated as would normally occur to one skilled in the art to which the invention relates. One embodiment of the invention is shown in great detail, although it will be apparent to those skilled in the relevant art that some features that are not relevant to the present invention may not be shown for the sake of clarity.

Figure 2:
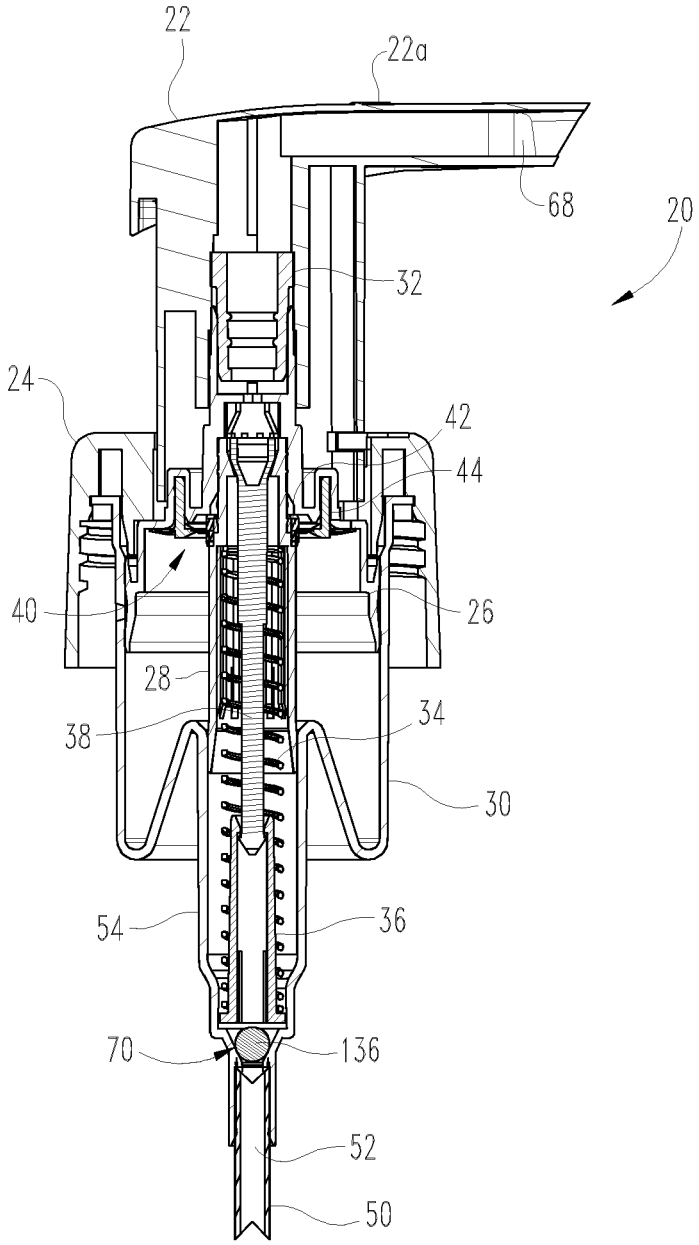
FIG. 2 is a side elevational view, in full section, of the FIG. 1 foam-dispensing pump.
Figure 3:
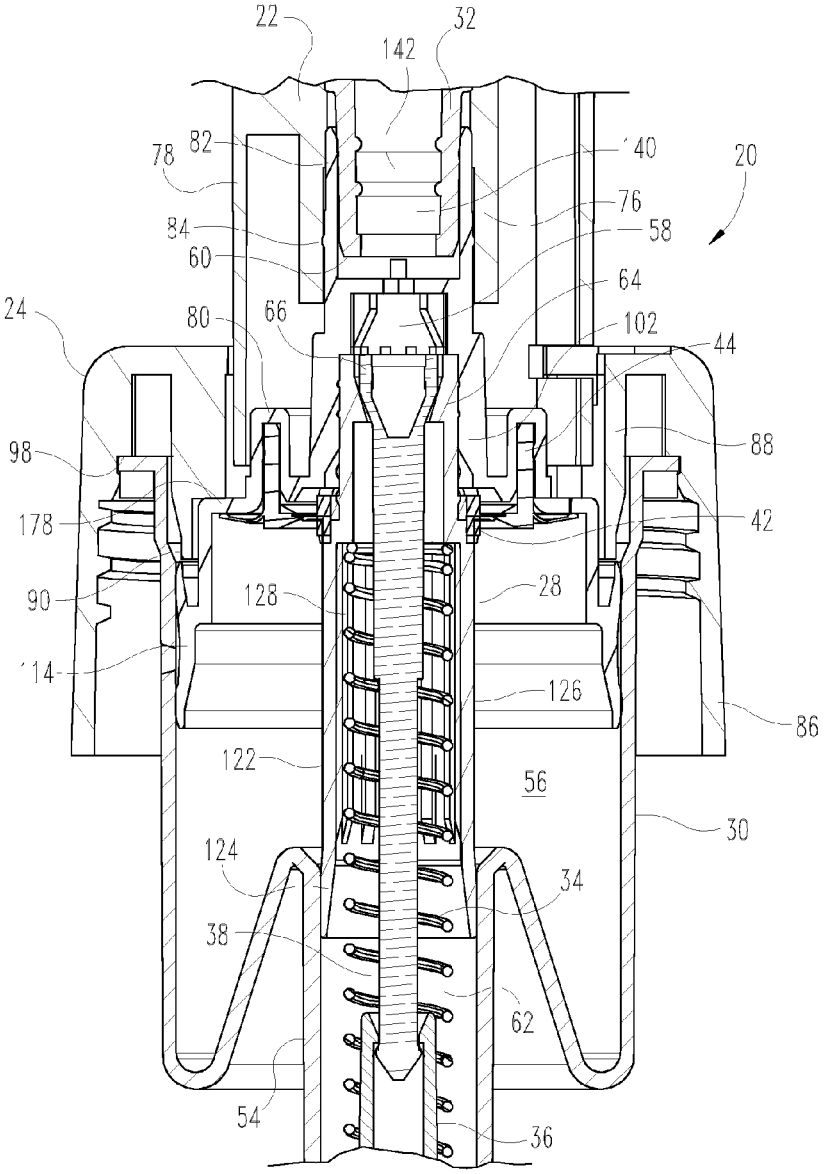
FIG. 3 is a partial, enlarged section view of the FIG. 2 illustration.

Referring to FIGS. 1, 2 and 3, a foam-dispensing pump 20 according to the present disclosure is illustrated. Pump 20 includes an actuator 22, a collar 24, an air piston 26, a liquid piston 28, a housing 30, a mesh insert 32, a spring 34, a spring stem 36 and a pull stick 38. These components cooperate for the delivery of an amount or dose of foam in response to a depression stroke (axially downward movement) of the actuator. Pump 20 further includes an air valve structure 40 (see FIG. 20) which includes an annular sleeve component 42 and a cooperating annular valve element 44.

Figure 4:
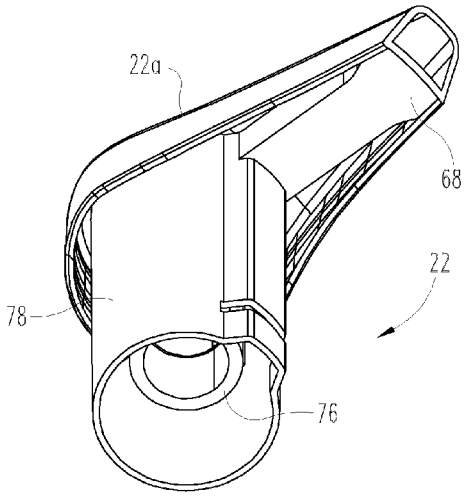
FIG. 4 is a bottom perspective view of an actuator which comprises one component part of the FIG. 1 foam-dispensing pump.
Figure 5:
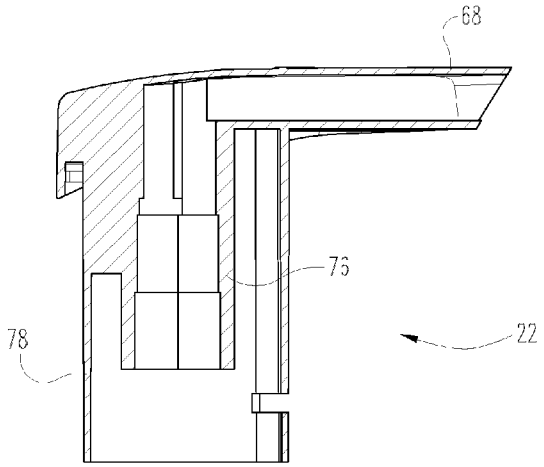
FIG. 5 is a side elevational view, in full section, of the FIG. 4 actuator.
Figure 6:
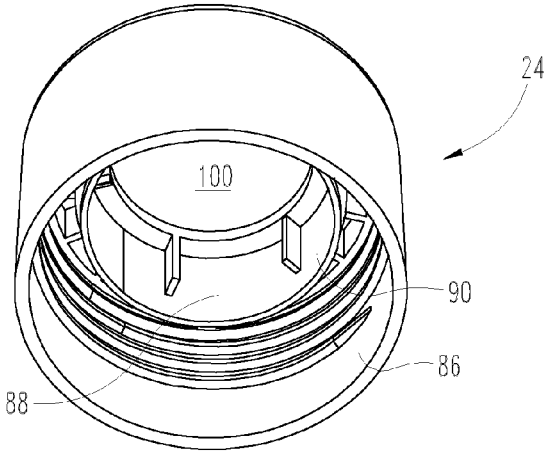
FIG. 6 is a bottom perspective view of a collar which comprises one component part of the FIG. 1 foam-dispensing pump.
Figure 7:
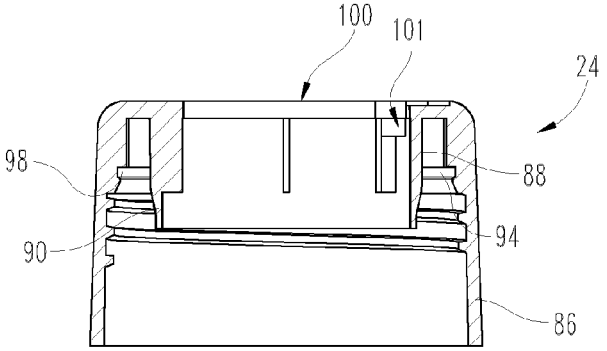
FIG. 7 is a side elevational view, in full section, of the FIG. 6 collar.
Figure 8:
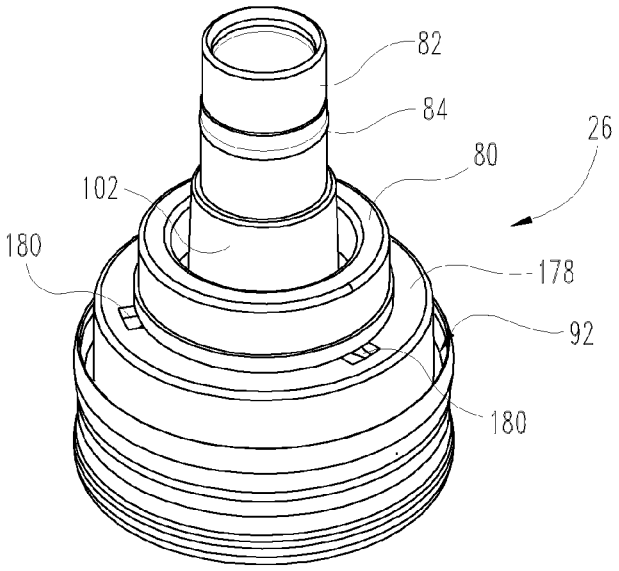
FIG. 8 is a top perspective view of an air piston which comprises one component part of the FIG. 1 foam-dispensing pump.
Figure 9:
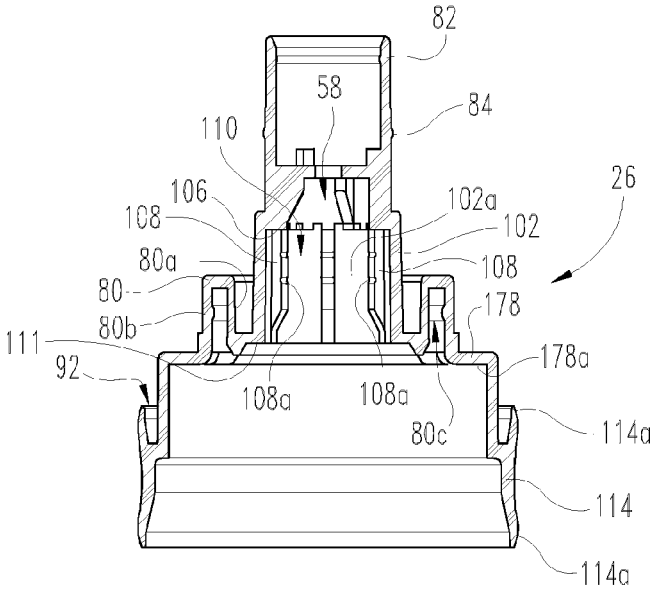
FIG. 9 is a side elevational view, in full section, of the FIG. 8 air piston.
Figure 10:
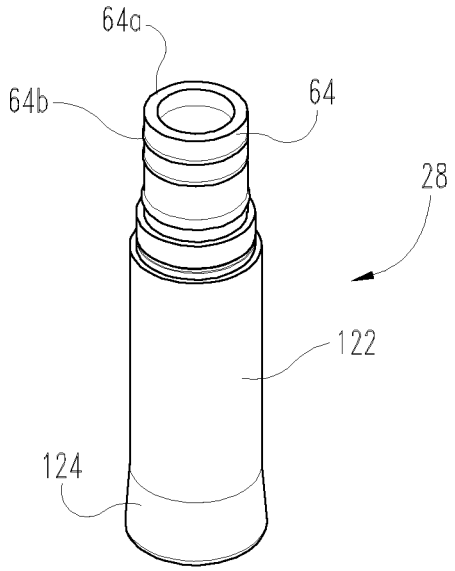
FIG. 10 is a top perspective view of a liquid piston which comprises one component part of the FIG. 1 foam-dispensing pump.
Figure 11:
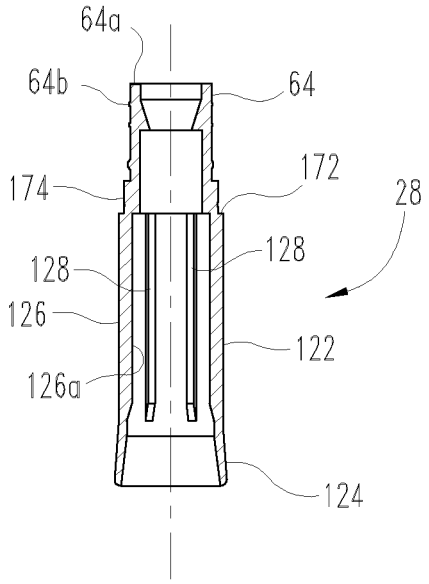
FIG. 11 is a side elevational view, in full section, of the FIG. 10 liquid piston.
Figure 12:
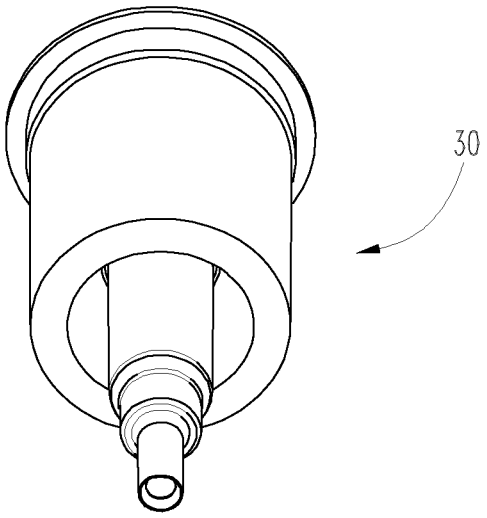
FIG. 12 is a bottom perspective view of a housing which comprises one component part of the FIG. 1 foam-dispensing pump.
Figure 13:
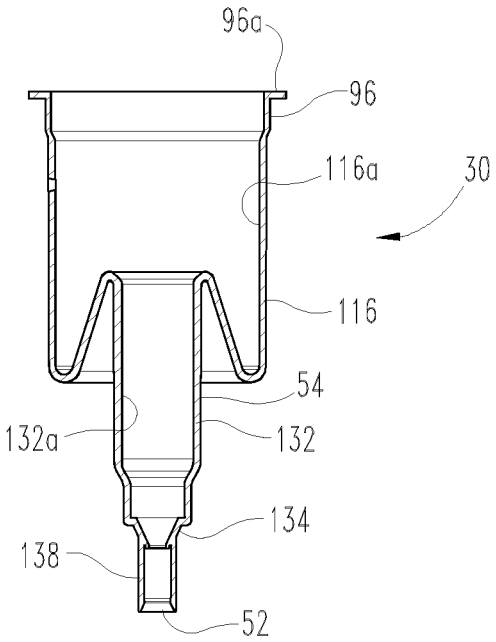
FIG. 13 is a side elevational view, in full section, of the FIG. 12 housing.
Figure 14:
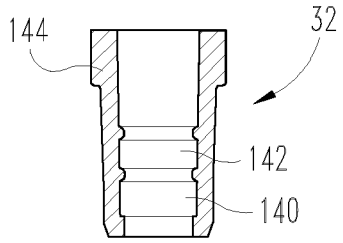
FIG. 14 is a side elevational view, in full section, of a mesh insert which comprises one component part of the FIG. 1 foam-dispensing pump.
Figure 15:
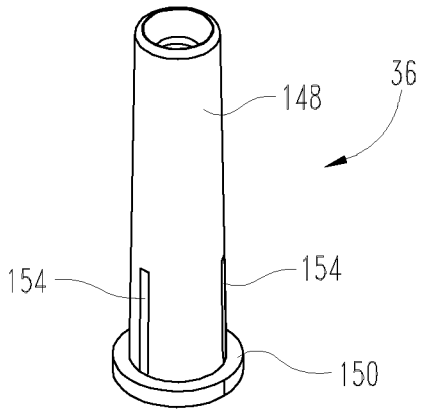
FIG. 15 is a top perspective view of a spring stem which comprises one component part of the FIG. 1 foam-dispensing pump.
Figure 16:
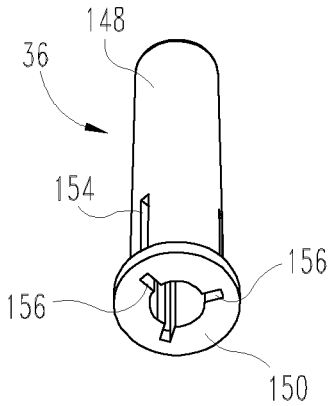
FIG. 16 is a bottom perspective view of the FIG. 15 spring stem.
Figure 17:
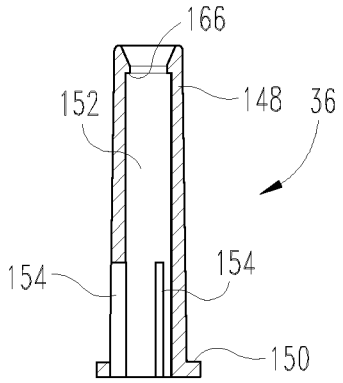
FIG. 17 is a side elevational view, in full section, of the FIG. 15 spring stem.
Figure 18:
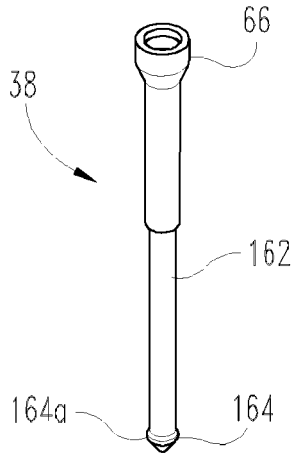
FIG. 18 is a top perspective view of a pull stick which comprises one component part of the FIG. 1 foam-dispensing pump.
Figure 19:
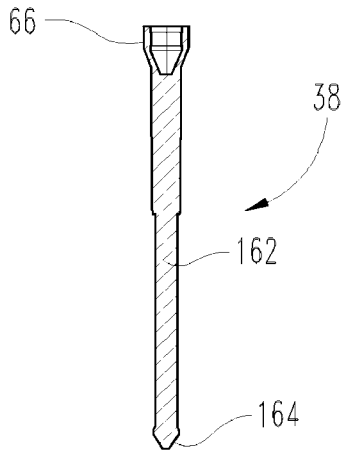
FIG. 19 is a side elevational view, in full section, of the FIG. 18 pull stick.
Figure 20:
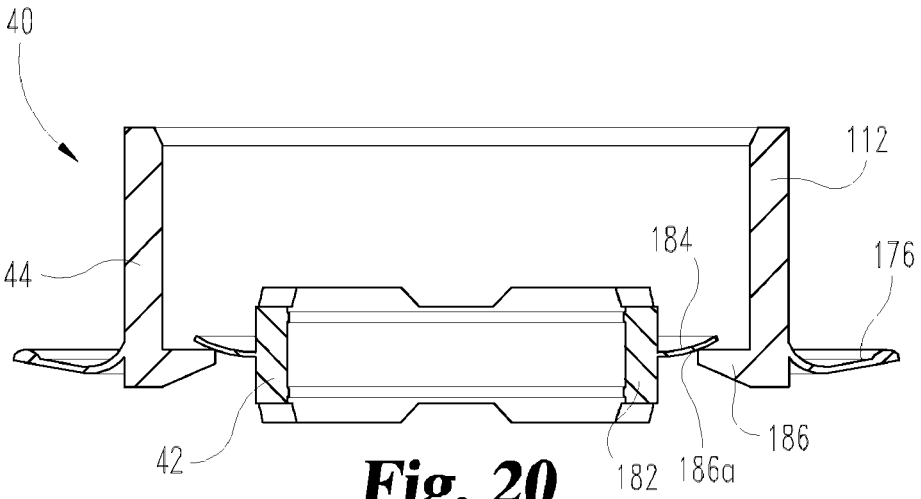
FIG. 20 is a side elevational view, in full section, of an air valve structure which comprises one portion of the FIG. 1 foam-dispensing pump.
Figure 21:
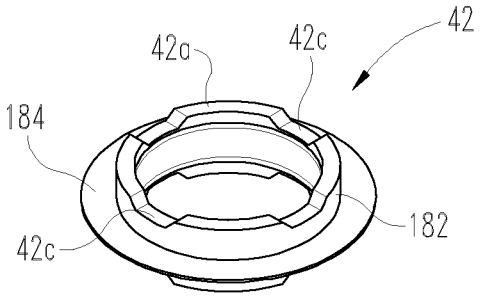
FIG. 21 is a top perspective view of an annular sleeve component which comprises one component part of the FIG. 20 air valve structure.
Figure 22:
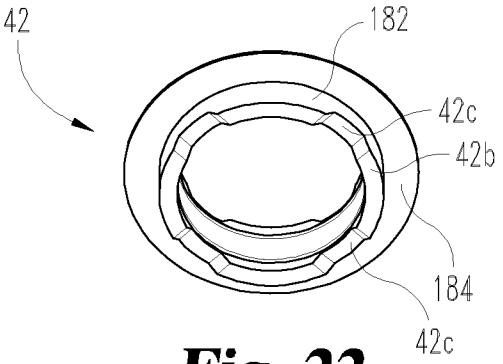
FIG. 22 is a bottom perspective view of the FIG. 21 annular sleeve component.
Figure 23:
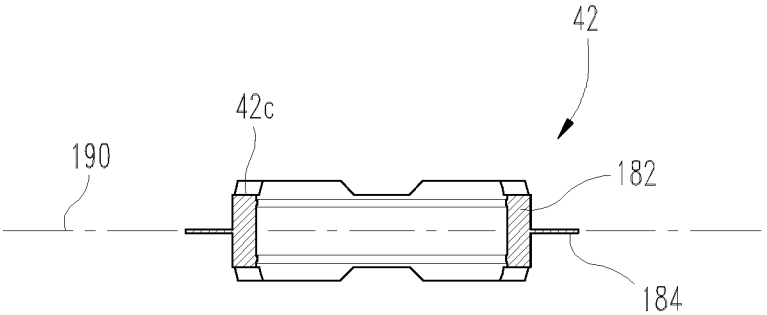
FIG. 23 is a side elevational view, in full section, of the FIG. 21 annular sleeve component.
Figure 24:
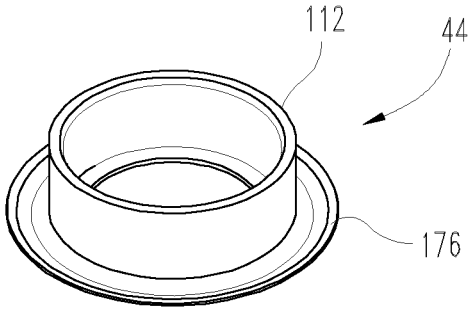
FIG. 24 is a top perspective view of an annular valve element which comprises one component part of the FIG. 20 air valve structure.
Figure 25:
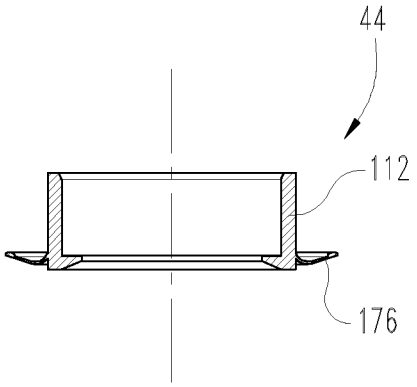
FIG. 25 is a side elevational view, in full section, of the FIG. 24 annular valve element.

The structural details of actuator 22 are illustrated in FIGS. 4 and 5. The structural details of collar 24 are illustrated in FIGS. 6 and 7. The structural details of air piston 26 are illustrated in FIGS. 8 and 9. The structural details of liquid piston 28 are illustrated in FIGS. 10 and 11. The structural details of housing 30 are illustrated in FIGS. 12 and 13. The structural details of mesh insert 32 are illustrated in FIG. 14. The structural details of spring stem 36 are illustrated in FIGS. 15, 16 and 17. The structural details of pull stick 38 are illustrated in FIGS. 18 and 19. The structural details of sleeve component 42 are illustrated in FIGS. 21, 22 and 23. The structural details of valve element 44 are illustrated in FIGS. 24 and 25. The manner of assembly of the air valve structure 40 into pump 20 and the cooperation between sleeve component 42 and valve element 44 is illustrated in FIG. 20.

With continued reference to FIGS. 1, 2 and 3, it is to be understood that the illustrated and disclosed foam-dispensing pump 20 is constructed and arranged to be threadedly assembled to the threaded neck of a suitable and corresponding dispensing container (not illustrated) which includes a supply of a selected liquid product. The selected liquid product depends on the intended or desired use for the foam, such as a cleaning product or a personal care product, as but a couple of examples. The connection between pump 20 and the dispensing container is by securely threading collar 24 onto the container neck until tight. Dip tube 50 provides the liquid connection or communication means between the liquid product in the dispensing container and pump 20. Dip tube 50 is constructed and arranged to slide into the interior opening of the end 52 of housing 30 with a slight interference fit. As such, dip tube 50 can be included and considered a part of pump 20 or alternatively, the dip tube 50 can be supplied as a separate component and not be considered a part of the pump 20. The length of dip tube 50 depends in part on the size of the container, a factor which favors supplying the dip tube 50 as a separate component.

In use, the pump 20 is assembled to a suitable dispensing container which is holding a supply of a selected liquid product, and the initial step which needs to be performed by a user is to manually push in a downward direction on the upper surface 22*a* of actuator 22. Considering the mechanical configuration and arrangement of the cooperating component parts, see FIGS. 2 and 3, pushing downwardly on actuator 20 as the stroke for creating a dose of foam causes axially downward travel of air piston 26 within housing 30. This same actuator 22 motion (i.e. downward travel) also causes axially downward travel of liquid piston 28 within a lower portion 54 of housing 30.

As the air piston 26 travels within housing 30, the interior volume of their defined space 56 is reduced thereby resulting in an increase in the interior air pressure within space 56. This increased interior air pressure causes a radially inner portion of the air valve structure 40 to "open" in order to force a dose or charge of air into a mixing area such as mixing chamber 58 which is adjacent the entry end 60 of the mesh insert 32. A radially outer portion of the air valve structure 40 remains "closed". Downward axial travel of the actuator 22 also effects downward axial travel of the liquid piston 28. The movement of the liquid piston 28 reduces the volume of space 62 which includes a charge of the liquid product. Concurrently with this downward movement, the upper end 64 of the liquid piston 28 separates from the enlarged head 66 of the pull stick 38. This separation creates a liquid flow path for liquid to flow into mixing chamber 58. The dose or charge of air and the dose or charge of liquid are combined within mixing chamber 58 before that air-liquid mixture is pushed into and through the mesh insert 32. The passage of the mixture through the mesh insert 32 results in the production of foam. The dose of foam which is produced is pushed out through the nozzle portion 68 of actuator 22.

The downward axial movement of the actuator 22 which in turn causes the downward axial movement of the air piston 26 and of the liquid piston 28 also causes the compression (i.e. shortening) of spring 34. When the manual force on the upper surface of the actuator 22 is relieved or released, the spring 34 is allowed to return to its extended starting condition. The spring force which is released as the spring returns to its starting condition causes the air piston 26 to move in an axially upward direction. This upward travel creates a negative pressure (i.e. a vacuum or suction) within defined space 56. This negative pressure causes the radially outward portion of the air valve structure 40 to "open" in order to admit make-up air into the defined space 56. While the air pressure within defined space 56 is being adjusted back to something close to atmospheric pressure, the radially inner portion of the air valve structure 40 begins to close. As soon as the positive pressure is lowered below the valve-open force level, the radially inner portion is closed.

The spring return force also drives the liquid piston 28 in an axially upward direction and the suction created opens the ball valve 70 and draws a new charge or dose of liquid up through the dip tube 50 from the liquid supply within the container. When the pressure within the defined space 56 is restored to substantially atmospheric pressure, the pump 20 is ready for another dispensing cycle (stroke) and the dispensing of another dose or charge of foam.

Referring now to FIGS. 4 and 5, the structural details of actuator 22 are illustrated. Actuator 22 is a unitary, single-piece, molded plastic component which includes nozzle portion 68, annular inner sleeve 76 and annular outer wall 78. The outer wall 78 is constructed and arranged to fit inside of collar 24 and to slide down around an annular wall portion 80 of air piston 26. In the preferred embodiment actuator 22 is "keyed" within a collar opening notch, by the use of wall projection 79. This keying structure prevents free rotation of the actuator 22 relative to the collar 24. Sleeve 76 is constructed and arranged to receive the annular upper extension 82 of air piston 26 with an interference fit due in part to the use of interference rib 84. The interior of upper extension 82 receives the lower portion of the mesh insert 32, also with a slight interference fit. The upper portion of the mesh insert 32 is received by sleeve 76, also with a slight interference fit.

Referring now to FIGS. 6 and 7, the structural details of collar 24 are illustrated. Collar 24 is a unitary, single-piece, molded plastic component which includes an annular, internally-threaded outer wall 86 and an annular inner wall 88. The outer wall 86 is constructed and arranged for its threads to mate with the external threads on the neck of a suitable and compatible dispensing container (not illustrated). The dispensing container retains a supply of a selected liquid product and individual doses or charges of that liquid product are drawn out by pump 20, mixed with air and aerated into a foam which is dispensed from nozzle portion 68.

The annular lower portion 90 of inner wall 88 fits within annular channel 92 of air piston 26. The space 94 between inner wall 88 and outer wall 86 received the upper portion 96 of housing 30, including radial flange 96*a*. Flange 96*a* seats up against annular ledge 98 of collar 24. Opening 100 receives the outer wall 78 of the actuator 22. The notch 101 receives wall projection 79.

Referring now to FIGS. 8 and 9, the structural details of air piston 26 are illustrated. Air piston 26 is a unitary, single-piece, molded plastic component which, in addition to those structural portions and features already identified, includes an annular, inner wall 102 which is generally concentric with extension 82 and which is positioned at the base of extension 82. The annular upper portion 64 of liquid piston 28 is received within inner wall 102. The upper surface 64*a* of portion 64 abuts up against annular ledge 106. Ledge 106 generally corresponds to where extension 82 transitions into inner wall 102. Axial ribs 108 (6 total) are molded integrally as part of the annular inner surface 102*a* of inner wall 102. Each rib 108 is formed with two (2) small, spaced-apart recesses 108*a* for a snap-fit assembly of the liquid piston 28 (specifically upper portion 64). The outer surface of upper portion 64 includes two (2), raised, spaced-apart ribs 64*b* which are constructed and arranged for a snap-fit into corresponding ones of recesses 108*a*. The use of ribs 108 creates six (6) air-flow passages 110 which are defined by surface 102*a*, portion 64 and ribs 108. These air-flow passages 110 provide a flow path for mixing air to flow from the defined space 56 into the mixing chamber 58.

The annular sleeve component 42, see FIGS. 21-23, fits around the upper portion of the liquid piston 28, specifically around wall portion 174 and rests on the ledge 172, as described herein. This in turn positions the upper edge 42*a* (or the lower edge 42*b*) up against or at least in close proximity to annular surface 111 of air piston 26. Since sleeve component 42 is symmetrical, top to bottom, around its horizontal centerline or center plane which extends through the approximate center of lip 184, sleeve component 42 is reversible top to bottom. This means that whichever edge 42*a* or 42*b* is oriented closest to the top of the actuator is the edge which is positioned adjacent to surface 111. Edges 42*a* and 42*b* can be though of as being a first axially outer surface or portion of sleeve component 42 and a second axially outer surface or portion of sleeve component 42. The recessed edge notches 42*c*, which are in both edges 42*a* and 42*b*, provide the requisite air-flow passages for the mixing air from defined space 56 to be able to flow into passages 110. Each axially outer surface 42*a* and 42*b* of sleeve component 42 defines four (4) recessed notches 42*c* which are circumferentially equally spaced. The lower portion of each rib 108 is inclined radially outwardly thereby creating a complete circumferential clearance ring or zone which is frustoconical in shape. This clearance ring or zone allows the air-flow through recessed notches 42*c* to reach passages 110 regardless of the rotational orientation of sleeve component 42.

The construction and arrangement of sleeve component 42, including its material selection, provides an improved air-flow for delivery of mixing air for the foam production. The flow openings and passages created by notches 42*c* in cooperation with passages 110, and the elastomeric properties of lip 184, result in larger openings and more air flow at a lower pressure. The positive pressure required to open or raise lip 184 is comparatively low as compared to prior art air valve structures and this construction facilitates the adequacy of the flow of mixing air and the responsiveness of the air valve structure 40.

Annular wall portion 80 includes an annular inner wall 80*a* and an annular outer wall 80*b*. Walls 80*a* and 80*b* are substantially concentric and cooperatively define therebetween annular groove 80*c*. Groove 80*c* receives an annular upper wall 112 of valve element 44 (see FIGS. 20, 24 and 25).

Air piston wall 114 is constructed and arranged for a tight sliding fit within housing 30. Wall 114 fits tightly up against the inner surface 116*a* of housing wall 116. The tight fit is for sealing, while still being at a force level which permits the sealing lips 114*a* of wall 114 to slide over the inner surface 116*a*. This sliding movement causes the volume of the defined space 56 to change in a controlled manner for both the delivery of mixing air and for drawing in make-up air.

Referring now to FIGS. 10 and 11, the structural details of liquid piston 28 are illustrated. Liquid piston 28 is a unitary, single-piece, molded plastic component which, in addition to those structural portions and features already identified, includes annular wall 122 which flares outwardly into annular sealing edge 124. The inner surface 126*a* of lower portion 126 of wall 122 includes six (6) axial ribs 128. Collectively and cooperatively, the inner surface of each rib 128 defines a generally cylindrical space which receives spring 34. Pull stick 38 extends through the center of spring 34 and its enlarged head 66 is received within upper portion 64 of liquid piston 28. Sealing edge 124 is constructed and arranged with a tight sliding fit against the inner surface 132*a* of wall 132 of housing 30. Edge 124 fits tightly up against the inner surface 132*a* and edge 124 slides on inner surface 132*a* with axial movement of actuator 20 and with return movement due to spring 34. This sliding movement causes the volume of lower portion 54 to change in a controlled manner for the delivery of mixing liquid and for drawing in another dose or charge of liquid.

Referring now to FIGS. 12 and 13 the structural details of housing 30 are illustrated. Housing 30 is a unitary, single-piece, molded plastic component which, in addition to those structural portions and features already identified, includes conical wall portion 134 which receives the ball 136 of the liquid check valve 70 which is created in part by wall portion 134. Housing 30 also includes generally cylindrical sleeve 138 which defines open end 52 and which is sized and arranged to receive dip tube 50 with a light interference fit.

Referring now to FIG. 14, the structural details of mesh insert 32 are illustrated. Mesh insert 32 is a annular structure with an interior size and shape which is suitable to capture a coarse mesh screen 140 and downstream therefrom, a fine mesh screen 142. Each mesh screen 140 and 142 is a unitary, single-piece, molded plastic component which has a suitable snap-in structure for secure placement and fit within body 144. Body 144 is a unitary, single-piece molded plastic component.

Referring now to FIGS. 15, 16 and 17, the structural details of spring stem 36 are illustrated. Spring stem 36 is a unitary, single-piece, molded plastic component which includes a generally cylindrical body 148 and an annular base flange 150. Body 148 defines a hollow interior 152 extending through the entire length of stem 36, including flange 150. Body 148 also defines three (3) slots 154 and each slot 154 extends from its closed end axially through base flange 150. Each slot creates a corresponding breakout opening 156 in the lower surface of base flange 150. Slots 154 provide passageways for the flow of liquid.

Referring now to FIGS. 18 and 19, the structural details of pull stick 38 are illustrated. Pull stick 38 is a unitary, single-piece, molded plastic component which, in addition to enlarged head 66, includes an elongate body 162 which extends between head 66 and base 164. Base 164 is received within spring stem 36, see FIGS. 2 and 3. Radial lip 164*a* abuts against inner annular edge 166 of spring stem 36. Elongate body 162 extends through a portion of the interior of spring 34.

Referring now to FIG. 20, air valve structure 40 is illustrated. Air valve structure 40 is a combination of annular sleeve component 42 (see FIGS. 21-23) and annular valve element 44 (see FIGS. 24 and 25). Sleeve component 42 is constructed and arranged to fit securely onto ledge 172 and around wall portion 174 of liquid piston 28. Valve element 44 includes upper wall 112 which is received within annular space 80*c*. Annular lip 176 which extends radially outwardly from wall 112 is flexed into a sealing preload against the inner surface 178*a* of upper wall 178. Wall 178 defines four (4) air apertures 180 and these air apertures are initially closed off by the presence of lip 176 as preloaded up against surface 178*a*. When a sufficient negative pressure (i.e. suction) is experienced within defined space 56, lip 176 is pulled away from its covering orientation over each aperture 180 thereby allowing make-up air to be drawn into defined space 56, via the four (4) apertures 180.

With continued reference to FIGS. 21-23, sleeve component 42 includes an annular body 182 and an outwardly radiating, annular flexible lip 184. The flexibility of lip 184 is due to a combination of the selected material as well as the size and the shape of lip 184. In the axial direction, the flexible lip 184 is positioned at the horizontal midpoint or centerline of the axial height of body 182. This means that the sleeve component 42 is reversible top to bottom due to its axial symmetry about a horizontal centerline 190. This reversible construction allows automated assembly as well as manual assembly of the sleeve component 42 without regard to any particular top or bottom orientation. The rotary orientation of sleeve component 42 does not matter due to the construction and arrangement of the air piston 26, as described above. Whichever edge 42*a*, 42*b* is oriented closest to the actuator is the edge which is adjacent (or contacting) surface 111. The interior of body 182 receives wall portion 174 while lip 184 is flexed into a sealing preload against the annular inner edge 186*a* of annular shelf 186 of valve element 44. The preferred material for sleeve component 42 is an injection moldable plastic which has a composition which, although still a plastic, is elastomeric in its deflection properties.

When a positive pressure is present within defined space 56, due to the axial movement of actuator 22 and thereby the movement of air piston 26, lip 184 is pushed upwardly (i.e. raised) off of edge 186*a*. The resulting separation between lip 184 and edge 186*a* creates an air-flow passage for air within defined space 56 to be delivered to the mixing chamber 58 for mixing with the charge of liquid for foam production. When the positive pressure is removed (due to the entry of make-up air) lip 184 closes back against edge 186*a*.

The air valve structure 40 provides a simple and reliable air valve for the delivery of mixing air and the receipt of make-up air. The structural shapes and cooperative interfit of lip 184 onto edge 186*a* provide added simplicity to the other component parts of pump 20.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. A foam-dispensing pump comprising:

an actuator;

a collar constructed and arranged for attachment to a liquid storage container, wherein a portion of said actuator is received by said collar;

a housing;

an air piston which is constructed and arranged to be moveable within said housing;

a liquid piston which is constructed and arranged to be moveable within said housing;

a mesh element which is constructed and arranged to receive air and liquid for the production of foam; and an air valve structure including an annular sleeve component assembled onto said liquid piston and a cooperating annular valve element received by said air piston, wherein said annular sleeve component is axially symmetrical about a horizontal centerline.

2. The foam-dispensing pump of claim 1 wherein said annular sleeve component includes an annular body and an outwardly radiating, flexible lip.

3. The foam-dispensing pump of claim 2 wherein said flexible lip generally coincides with a horizontal centerline.

4. The foam-dispensing pump of claim 2 wherein said annular body includes a first edge which defines a recessed notch and a second edge which defines a recessed notch.

5. The foam-dispensing pump of claim 2 wherein said air valve structure is constructed and arranged with said flexible lip in a deflected orientation against a portion of said annular valve element.

6. The foam-dispensing pump of claim 5 wherein said portion is a radially-inner annular edge of said annular valve element.

7. The foam-dispensing pump of claim 1 wherein said annular sleeve component includes an annular lip which is preloaded against said annular valve element.

8. The foam-dispensing pump of claim 7 wherein said annular sleeve component is axially reversible.

9. The foam-dispensing pump of claim 8 wherein said annular sleeve component includes an axially outer surface which defines a plurality of air-flow apertures.

10. The foam-dispensing pump of claim 1 wherein said annular sleeve component is constructed and arranged with a first axially outer surface and with a second axially outer surface.

11. The foam-dispensing pump of claim 10 wherein the assembly of said foam dispensing pump positions either one of said axially outer surfaces adjacent a surface of said piston due to the reversible construction of said annular sleeve component.

12. The foam-dispensing pump of claim 11 wherein each axially outer surface defines a recessed notch.

13. A foam-dispensing pump comprising:

an actuator;

a collar constructed and arranged for attachment to a liquid storage container, wherein a portion of said actuator is received by said collar;

a housing;

an air piston which is constructed and arranged to be moveable within said housing;

a liquid piston which is constructed and arranged to be moveable within said housing;

means for the production of foam; and an air valve structure constructed and arranged with a first component assembled into the air piston and with a cooperating second component assembled onto the liquid piston, wherein said second component includes an annular sleeve component which includes an annular body and an outwardly radiating, flexible lip and wherein said annular body includes a first edge which defines a recessed notch and a second edge which defines a recessed notch.

14. The foam-dispensing pump of claim 13 wherein said second component is axially symmetrical about a horizontal centerline.

15. The foam-dispensing pump of claim 13 wherein said air valve structure is constructed and arranged with said flexible lip in a deflected orientation against a portion of said first component.

16. An air valve structure for use in a foam-dispensing pump which includes an air piston and a liquid piston, said air valve structure comprising:

an annular sleeve component which is constructed and arranged to assemble onto a portion of said liquid piston; and an annular valve element which is constructed and arranged to assemble into a portion of said air piston; wherein said annular sleeve component includes an outwardly radiating flexible lip which is preloaded into deflected engagement against said annular valve element.

17. The air valve structure of claim 16 wherein said annular valve element includes a radially inner edge and wherein said flexible lip is preloaded into deflected engagement against said radially inner edge of said annular valve element.

18. The air valve structure of claim 17 wherein said annular sleeve component includes an annular body which includes the first edge which defines a recessed notch and a second edge which defines a recessed notch.

* * * * *